United States Patent [19]

Brown

[11] 4,211,121

[45] Jul. 8, 1980

[54] VIBRATOR WITH ECCENTRIC WEIGHTS

[75] Inventor: William R. Brown, Blairsville, Pa.

[73] Assignee: FMC Corporation, San Jose, Calif.

[21] Appl. No.: 899,042

[22] Filed: Apr. 24, 1978

Related U.S. Application Data

[62] Division of Ser. No. 719,634, Sep. 1, 1976, abandoned.

[51] Int. Cl.[2] ..... B06B 1/16

[52] U.S. Cl. ..... 74/87; 366/116; 366/128

[58] Field of Search ..... 74/571 M, 87; 259/DIG. 42; 366/116, 128

[56] References Cited

U.S. PATENT DOCUMENTS

| | | | |
|---|---|---|---|
| 2,008,296 | 7/1935 | Soldan | 74/87 |
| 2,852,946 | 9/1958 | Petrin | 74/87 X |
| 2,930,244 | 3/1960 | Hutchinson et al. | 74/87 X |
| 2,937,537 | 5/1960 | Woll | 74/87 X |
| 3,192,839 | 7/1965 | Vivier | 74/87 X |
| 3,640,508 | 2/1972 | Reibig | 74/87 |
| 3,920,222 | 11/1975 | Brander | 74/87 X |

FOREIGN PATENT DOCUMENTS

| | | | |
|---|---|---|---|
| 1458578 | 1/1969 | Fed. Rep. of Germany | 74/87 |
| 274430 | 9/1970 | U.S.S.R. | 259/DIG. 42 |

*Primary Examiner*—Samuel Scott
*Assistant Examiner*—Lee E. Barrett
*Attorney, Agent, or Firm*—J. W. Edwards

[57] ABSTRACT

Two eccentric weights of a vibrator are mounted, respectively, on two coaxial shafts, one of which is a hollow shaft mounted on the other shaft. The two shafts can be connected for rotation in unison, and can be separated for relative rotation to alter the angular relationship between the weights. The mechanism is provided to alter the angular relationship between the weights while both shafts continue to rotate. An electric clutch is connected between the driven shaft and the hollow shaft to connect the two coaxial shafts for rotation in unison, and a brake is provided to slow the rotation of the hollow shaft after the clutch is disengaged. Thus, the angular relationship between the eccentric weights, and hence the stroke of the vibrator, can be changed.

8 Claims, 4 Drawing Figures

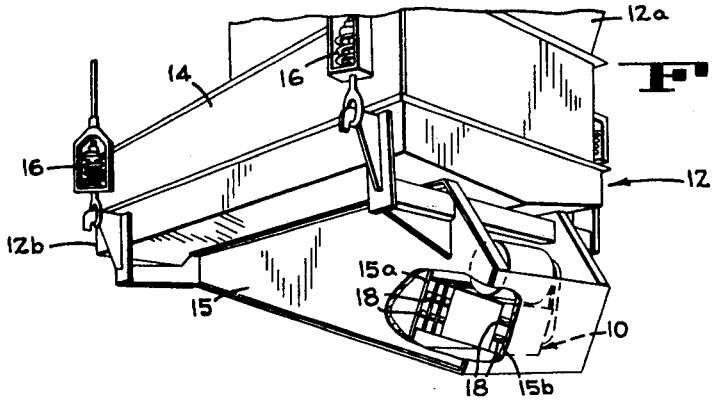
FIG_1
FIG_4
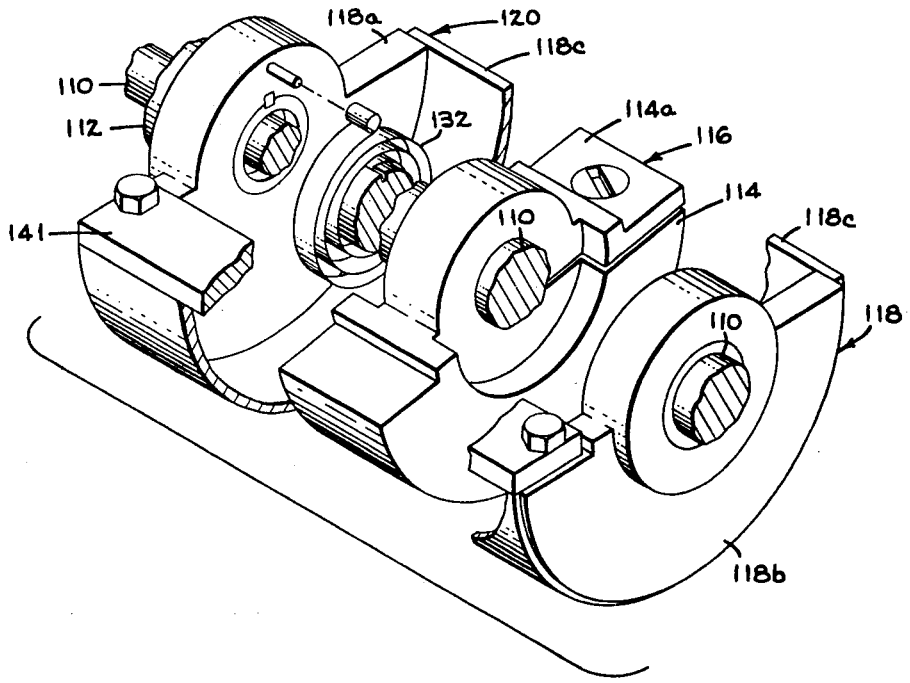

VIBRATOR WITH ECCENTRIC WEIGHTS

This is a division of application Ser. No. 719,634 filed Sept. 1, 1976, now abandoned.

BACKGROUND OF THE INVENTION

1. Field of the Invention

The present invention relates to vibrators, and, more particularly, to vibrators utilizing eccentric weights to produce the desired vibrations.

2. Description of the Prior Art

Vibrators are used to induce vibrations in various types of industrial equipment for diverse purposes such as feeding material, screening material, or dislodging material. In some applications, such as in a two mass vibrating system used to feed material at a predetermined rate, the magnitude of the stroke of the vibrator is important.

One method of producing vibrations in a vibrator is by use of a rotating shaft with an eccentric weight, or weights thereon. Frequently, as shown, for example, in the U.S. Pat. Nos. 2,934,202; 3,396,294; 3,920,222; and 3,922,043 two or more eccentric weights are used which can be set at different angular positions on the driven shaft relative to each other to change the total effective eccentricity of the weights, and therefore to change the stroke of the vibrator. In the usual eccentric weight vibrator, it is difficult to change the relative angularity of the weights, and the vibrator must be stopped to accomplish the modification.

In at least the following patents (U.S. Pat. Nos. 3,920,222; 698,103; 2,677,967; 3,091,712; 3,192,839; and Russian Pat. No. 274430), apparatus has been provided for the purpose of changing the angle between the eccentric weights while the vibrator is running.

SUMMARY OF THE INVENTION

In the present invention, a vibrator is provided with an improved mounting for the eccentric weights which facilitates the angular adjustment of two weights relative to each other. The mounting of the eccentric weights in accordance with the present invention lends itself to adjustment of the eccentric weights while the vibrator is running, and two different systems for accomplishing this desirable goal in an effective, positive manner are disclosed.

In brief, in accordance with the present invention, two eccentric weights are mounted, respectively, on two coaxial shafts. The two coaxial shafts can be connected together for rotation in unison, and can be disconnected for relative rotation to alter the angular relationship between the weights. The coaxial shafts include a driven shaft, and, preferably, a hollow shaft mounted on the driven shaft. The shafts can extend to convenient points remote from the eccentric weights (as, for example, outside the vibrator housing) to facilitate the change of angular relationship between the weights.

In the invention, the angular relationship between the weights can be changed while both shafts continue to rotate.

It is the object of the present invention to provide improved power operated mechanism to change the relative angular position between weights while the vibrator is running.

BRIEF DESCRIPTION OF THE DRAWINGS

FIG. 1 is a view in perspective of an electromechanical vibrating feeder incorporating the vibrator of the present invention.

FIG. 4 is an exploded view in perspective of the eccentric weights of the vibrator of FIG. 2.

DESCRIPTION OF THE PREFERRED EMBODIMENT

Figure 2:
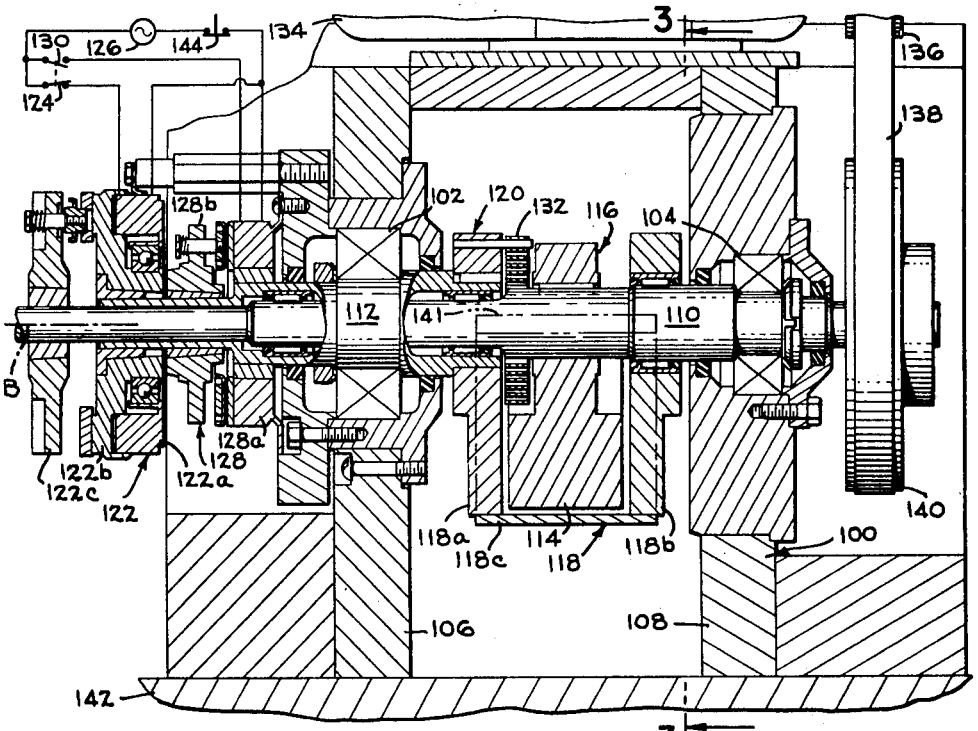
FIG. 2 is a side sectional view of a vibrator constructed in accordance with the present invention.

There is shown in FIG. 1 a vibrator 10 constructed in accordance with the present invention. The vibrator 10 is shown, for illustrative purposes, as the driving force of a vibratory feeder 12 which is designed to receive material at an input end **12*a* and discharge material at a discharge end 12*b***. The vibrator of the present invention can be used to drive other machines, such as vibratory screens or, in fact, any equipment which it is desired to vibrate.

It will be understood by those skilled in the art that the feeder 12 includes a trough 14 which is suspended by springs 16 from an overhead support. The feeder has a drive housing 15 which is rigidly connected to trough 14, and the housing 15 has spaced walls **15*a*, 15*b*. The vibrator 10 is mounted by means of springs 18 between the walls 15*a*, 15*b*** to form with the trough a two mass, spring coupled, electromechanical vibratory feeder.

Figure 3:
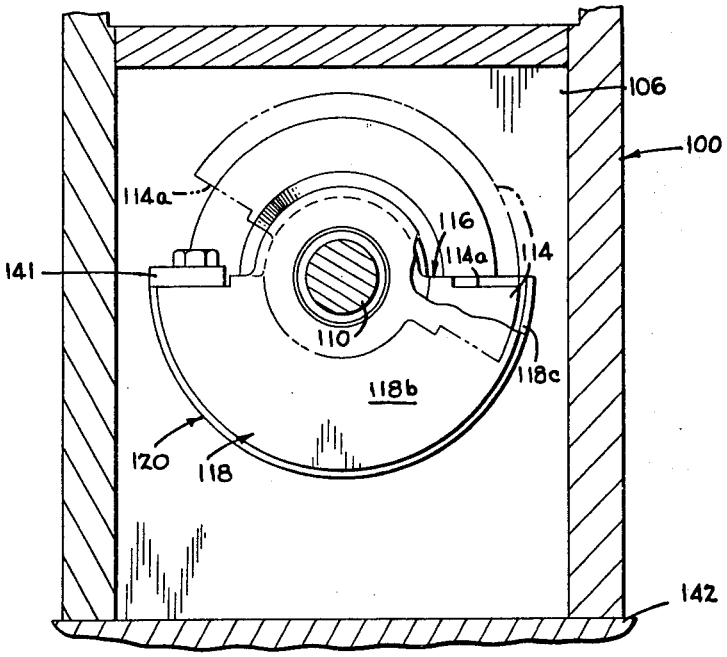
FIG. 3 is a view taken on the line 3—3 of FIG. 2.

There is shown in FIGS. 2, 3 and 4 an embodiment of the present invention. In this embodiment, a housing 100 has bearings 102 and 104 mounted in openings in sidewalls 106, 108. Bearing 104 receives a shaft 110 for rotation on an axis B on which both bearings 102, 104 lie. A hollow shaft 112 is mounted on shaft 110, and is received in bearing 102 for rotation in axis B.

A first eccentric weight 114, which is secured to shaft 110, has a center of gravity spaced from the axis B, which is the longitudinal axis of rotation of shaft 110. The weight 114, and the shaft 110 on which it is eccentrically mounted, constitute a first eccentric element 116. A second weight 118 consists of two side members **118*a*, 118*b*, which straddle the weight 114, and an arcuate perimeter member 118*c* outboard of weight 114 to connect the side members 118*a*, 118*b*. One side member 118*a* of weight 118 is keyed on hollow shaft 112 for rotation therewith, and the other side member 118*b* is rotatably mounted on shaft 110. The weight 118 has a center of gravity spaced from axis B, and is therefore eccentric with respect to hollow shaft 112. The weight 118 and the hollow shaft 112 constitute a second eccentric element 120**.

An electric clutch 122 (which may be similar to Model SFC-650 of the Warner Electric Brake & Clutch Company, Beloit, Wisconsin) is connected between shaft 110 and hollow shaft 112. The clutch has an electro-magnetic stationary unit **122*a* connected to housing 100. A rotor 122*b* is received on hollow shaft 112 for rotation therewith, and an armature 122*c* is received on shaft 110 for rotation therewith. When switch 124 is closed to connect the terminals of unit 122*a* across the source of energy 126, the armature engages the rotor for rotation is unison of shaft 110 and hollow shaft 112**.

An electric brake 128 (which may be similar to Model PB-500 of the Warner Electric Brake & Clutch Company, Beloit, Wisconsin) has a stationary magnetic unit **128*a* which is connected to housing 100**. An armature 128*b* is mounted on hollow shaft 112 for rotation therewith. When switch 130 is closed (and switch 124 simultaneously opened) the magnetic member 128*a* is connected across energy source 126 to engage the armature 128*b* with stationary unit 128*a* and retard the rotation of hollow shaft 112. At the same shaft 112 from the shaft 110.

A flat coil spring 132 has one end connected to shaft 110 (of first eccentric element 116) and the opposite end to weight 118 (of second eccentric element 120). Thus, the spring exerts a bias between the first eccentric element 116 and the second eccentric element 120 tending to urge these members toward positions where the eccentric elements are in opposed relationship for minimum eccentricity.

An electric motor 134 is mounted on housing 100. A pulley 136 mounted on the motor drive shaft (not shown) is connected by belt 138 to a pulley 140 on shaft 110.

During normal operation of the vibrator, motor 134 is driving shaft 110, and switch 124 is closed (switch 130 open) to energize clutch 122. Thus, clutch 122 is engaged to connect shaft 110 and hollow shaft 112 for rotation in unison. At this time the eccentric weights are in relative position for minimum eccentricity, with abutment surface 114*a* of weight 114 engaged with stop bar 141. In this relative position, the stroke of the driven unit 142 (which may, for example, be a conveyor or a vibrating screen), is minimum. If it is desired to increase the stroke, the switch 124 is momentarily opened (disconnecting hollow shaft 112 from shaft 110), and the switch 130 momentarily closed, to energize the brake. The energization of the brake retards the rotation of hollow shaft 112 while shaft 110 continues to rotate at its normal speed. As sleeve 112 is retarded, the relative position of the weights changes, increasing the eccentricity of the combined weights 114 and 118. At the same time, the spring 132 winds up, storing potential energy. The switch 124 is intermittently opened and closed while simultaneously the switch 130 is intermittently closed and opened until the relative position of the weights produces the desired stroke, at which time the switch 124 is held closed and the switch 130 is held open. Thus, the shaft 110 and hollow shaft 112 are again connected together for rotation in unison. When, eventually, a smaller stroke is again desired, the switch 144 is intermittently opened and closed to momentarily deenergize the clutch (without energizing the brake) to permit the spring 132 to return the weights to the desired angular relationship, at which time switch 144 is again closed. Since switch 124 is already closed (and switch 130 open), the clutch 122 again connects shaft 110 to hollow shaft 112.

Although the best mode contemplated for carrying out the present invention has been herein shown and described, it will be apparent that modification and variation may be made without departing from what is regarded to be the subject matter of the invention.

What is claimed is:

1. A vibrator comprising two members rotatable about a common axis, an eccentric weight connected to each of said members, means to drive one of said members, a clutch means connectable between said members in any angular relationship therebetween for rotation of both members when said one member is driven and said clutch means is engaged, means to disengage said clutch means while said one shaft is driven, and a brake means to retard the rotation of the other member when said clutch means is disengaged and said brake is applied to change from one angular relationship between said members to any desired different angular relationship between the members.

2. A vibrator comprising a driven shaft, means to rotate said driven shaft, a hollow shaft mounted on the driven shaft, a first eccentric weight mounted on the driven shaft, a second eccentric weight mounted on the hollow shaft, a clutch means connectable between the driven shaft and the hollow shaft in any angular relation of said shafts selectively to connect the driven shaft and the hollow shaft to hold said eccentric weights in any desired fixed angular relationship as the driven shaft and hollow shaft are rotated in unison, means to disengage said clutch means while said driven shaft is rotating, and a brake means to retard the hollow shaft relative to the driven shaft to alter the relationship between said eccentric weights from one relative angular position to any other selected angular position.

3. A vibrator comprising a first shaft, a first eccentric weight mounted on said first shaft, said first weight and first shaft defining a first eccentrically weighted element, a hollow shaft mounted on the first shaft, a second eccentric weight mounted on said hollow shaft, said second eccentric weight and hollow shaft defining a second eccentrically weighted element, a clutch means connectable between said first and second eccentrically weighted elements in any angular relationship therebetween to selectively connect said elements for rotation in unison, means to rotate one of said eccentrically weighted elements, means to disengage said clutch means while said one eccentrically weighted element is rotating, and a brake means connected to the other of said eccentrically weighted elements to retard rotation of said other of said eccentrically weighted elements when the clutch means is disengaged to change from one angular relationship between said members to any other selected angular relationship between said members.

4. A vibrator comprising a first shaft, a first eccentric weight connected to the first shaft, said first weight and said first shaft defining a first eccentric element, a hollow shaft mounted on the first shaft, a second eccentric weight connected to the hollow shaft, said hollow shaft and said second weight defining a second eccentric element, a clutch means connectable between said first and second eccentric elements to selectively connect said elements on engagement of the clutch means in any desired angular relationship of said elements, means to drive one of said elements for rotation of both of said elements in unison when said clutch means is engaged, means to disengage said clutch means while said one element is being driven, a brake means to retard the other of said eccentric elements when the clutch means is disengaged to alter the relative angular position of the weights to any desired angular relationship, and a spring means connected between said first and second eccentric elements to bias said elements toward a predetermined angular relationship.

5. A vibrator having two concentric shafts each having an eccentric weight secured thereon, a drive motor connected to one of said shafts for power rotation thereof, an electric clutch means having a rotor and an armature secured on said shafts for selective connection of said shafts and disengagement of said shafts in any relative angular position of said shafts, characterized by a brake means having an armature secured to the other of said shafts to retard said other shaft when the brake means is applied, and clutch control means to disengage said shafts when said brake means is applied and while said one shaft is driven by said motor to thereby change the angular relationship between said shafts and said eccentric weights from a predetermined angular relationship to any desired angular relationship, and a spring means connected between said shafts to store energy when said shafts are shifted from said predetermined angular relationship, and to release energy when said clutch means is released to disengage said shafts and to move said eccentric weights toward said predetermined angular relationship.

6. The apparatus of claim 5 wherein said one shaft is received inside said other shaft, said clutch means armature is connected to said one shaft, said clutch means rotor is connected to said other shaft, characterized by the fact that an electromagnetic stator is mounted adjacent said rotor to draw, when energized, said armature into engagement with said rotor to connect said shafts for rotation in unison.

7. The apparatus of claim 6 characterized by a stationary electromagnetic means, said brake means to draw when energized, said brake armature into said stationary means to retard said other shaft.

8. The apparatus of claim 5 wherein said spring means urges said shafts toward said predetermined position and said eccentric weights are in a balanced position when said shafts are in said predetermined position.

* * * * *

UNITED STATES PATENT AND TRADEMARK OFFICE

CERTIFICATE OF CORRECTION

PATENT NO. : 4,211,121

DATED : July 8, 1980

INVENTOR(S) : BROWN, W. R.

It is certified that error appears in the above—identified patent and that said Letters Patent is hereby corrected as shown below:

Col. 3, line 6, after "same" insert --time, the clutch is deenergized to release the hollow--.

Col. 4, line 60, before "A" insert --In-- and change "A" to --a--;

line 66, delete "characterized by" and insert --the improvement comprising--.

Col. 5, line 13, delete "apparatus" and insert --improved vibrator--.

Col. 6, lines 2 and 3, delete "characterized by the fact that" and insert --and--;

line 6, delete "apparatus" and insert --improved vibrator--;

same line, delete "characterized by" and insert --wherein said brake means has thereon--;

line 7, delete ", said brake means";

same line, insert a comma after "draw";

line 11, delete "apparatus" and insert --improved vibrator--.

Signed and Sealed this

Eighteenth Day of November 198(

[SEAL]

Attest:

SIDNEY A. DIAMOND

Attesting Officer

Commissioner of Patents and Trademar